United States Patent [19]

Patel

[11] Patent Number: 5,035,656

[45] Date of Patent: Jul. 30, 1991

[54] CONNECTOR, CIRCUIT BOARD CONTACT ELEMENT AND RETENTION PORTION

[75] Inventor: Kanti D. Patel, Camp Hill, Pa.

[73] Assignee: E. I. Du Pont de Nemours and Company, Wilmington, Del.

[21] Appl. No.: 523,565

[22] Filed: May 15, 1990

[51] Int. Cl.[5] ..... H01R 13/42

[52] U.S. Cl. ..... 439/733; 439/78

[58] Field of Search ..... 439/733, 869, 78, 84, 439/736, 82, 751, 873

[56] References Cited

U.S. PATENT DOCUMENTS

| | | | |
|---|---|---|---|
| 3,897,131 | 7/1975 | Stauffer | 339/220 |
| 4,274,699 | 6/1981 | Keim | 439/751 |
| 4,381,134 | 4/1983 | Anselmo et al. | 339/220 |
| 4,655,537 | 4/1987 | Andrews, Jr. | 439/82 |
| 4,698,026 | 10/1987 | Rolf | 439/82 |
| 4,728,164 | 3/1988 | Lemmens et al. | 439/873 |
| 4,752,250 | 6/1988 | Seidler | 439/82 |
| 4,867,690 | 9/1989 | Thumma | 439/79 |

FOREIGN PATENT DOCUMENTS

| | | | |
|---|---|---|---|
| 2435461 | 2/1975 | Fed. Rep. of Germany | 439/751 |
| 2643158 | 9/1977 | Fed. Rep. of Germany | 439/733 |

*Primary Examiner*—Gary F. Paumen

*Attorney, Agent, or Firm*—John E. Griffiths

[57] ABSTRACT

The present invention relates to circuit board contact elements and compliant sections thereof which are mounted in plated-through holes in printed circuit boards, generally in conjunction with a plastic header or other electrical connectors.

22 Claims, 3 Drawing Sheets

48

46

44

42

FIG.9
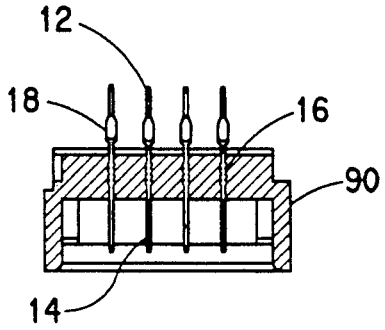
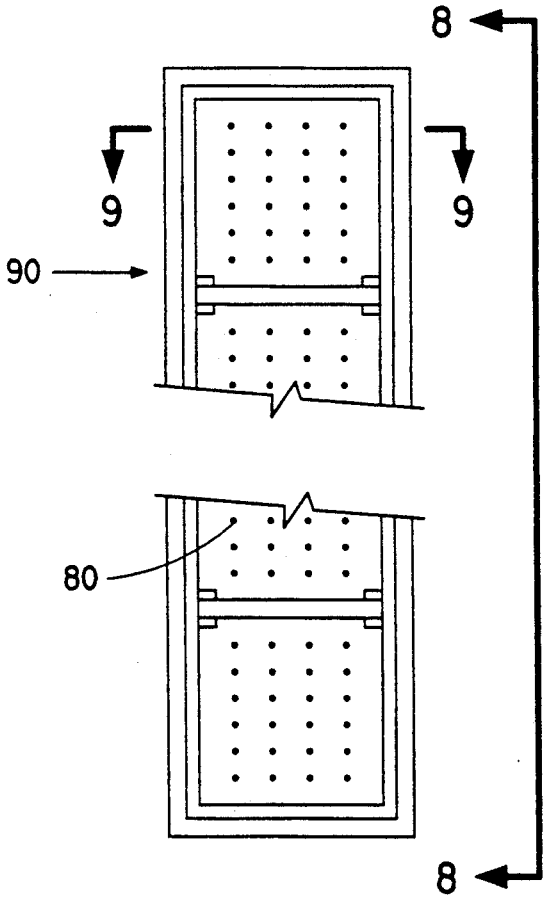
FIG.7
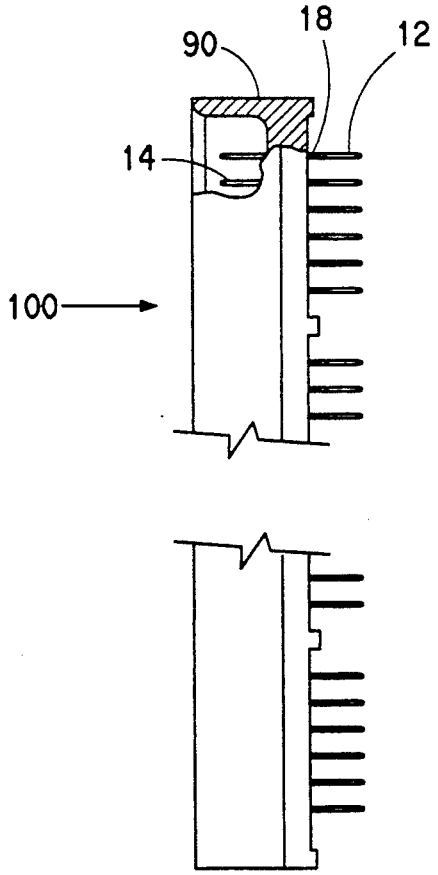
FIG.8

CONNECTOR, CIRCUIT BOARD CONTACT ELEMENT AND RETENTION PORTION

BACKGROUND OF THE INVENTION

1. Field of the Invention

This invention relates to circuit board contact elements and retention sections thereof which are for mounting in holes in connector housings, specifically header housings.

2. Description of Related Art

Electrical contacts, otherwise referered to as terminals, contact elements or pins, are used in the electronics industry in conjunction with printed circuit (PC) boards and panel boards for making electrical connections between, and among, circuits.

A plurality of the contacts are frequently mounted in an insulative connector housing with one end of contacts extending from the connector housing for making mechanical and electrical contact with a conductive path on the PC board. The other end of the contacts typically extent through holes in the connector housing for mechanical and electrical connection with contacts in a mating connector.

In a high pin count (HPC) header which is a commercially available male connector, contacts or wire pins having a 0.025 inch square cross section are staked in round holes in a plastic housing. Retention of the pins in the housing is achieved by an interference fit between corners of the square pin and the round hole in the housing. The pins are made from phosphor bronze and plated with gold over nickel under plating. The housing is made from polyetheremide resin. During the staking process, slivers of plated coatings are formed due to scraping on the pin corners. These slivers present a potential for electrical short. As such, these slivers are removed by brushing, blowing and/or washing operations at added cost.

It is an object of this invention to provide a retention portion of an electrical contact element that substantilaly does not produce slivers when staked in a hole through a connector housing.

Further, it is an object of this invention to provide a retention portion of an electrical contact element that substantially does not produce slivers when staked in a hole through a header housing.

Further, it is an object of this invention to provide a retention portion of an electrical contact element that substantially does not produce slivers when staked in a hole through a header housing made of a high temperature resin.

SUMMARY OF THE INVENTION

The invention is directed to a retention portion of an electrical contact element for mechanical connection in a hole through a connector housing comprising:

a plurality of opposed upsets of progressively different sizes, whereby when the element is inserted into the hole such that only the upsets come in contact with a wall of the hole when inserted therein, the offsets provide an incremental interference with the hole during insertion while substantially preventing sliver formation.

The invention is further directed to an electrical contact element for mechanical connection in a hole through a connector housing comprising:

a force receiving end portion;

an insertion end portion; and a retention section between the force receiving end portion and the insertion end portion, the retention section including a plurality of opposed upsets of progressively different sizes, whereby when the insertion end portion is inserted into the hole such that only the upsets come in contact with a wall of the hole when inserted therein, the offsets provide an incremental interference with the hole during insertion while substantially preventing sliver formation.

The invention is further directed to an electrical connector comprising:

a housing having a plurality of hole arranged in rows and columns;

an electrical contact element for mechanical connection in each one of the holes, each one of the electrical contact elements comprising:

a force receiving end portion;

an insertion end portion; and a retention section between the force receiving end portion and the insertion end portion, the retention section including a plurality of opposed upsets of progressively different sizes, whereby when the insertion end portion is inserted into the hole such that only the upsets come in contact with a wall of the hole when inserted therein, the offsets provide an incremental interference with the hole during insertion while substantially preventing sliver formation.

BRIEF DESCRIPTION OF THE DRAWINGS

The invention can be more fully understood from the following detailed description thereof in connection with accompanying drawings which form a part of this application and in which:

FIG. 7 a top side view of a header having a plurality of the electrical contact elements of the present invention staked in oblong holes through the header housing.

FIG. 8 a right side view of the header of FIG. 7 taken on the line 8—8 in the direction of the arrows.

FIG. 9 a cross sectional view of the header of FIG. 7 taken on the line 9—9 in the direction of the arrows.

DESCRIPTION OF THE PREFERRED EMBODIMENT(S)

Figure 1:
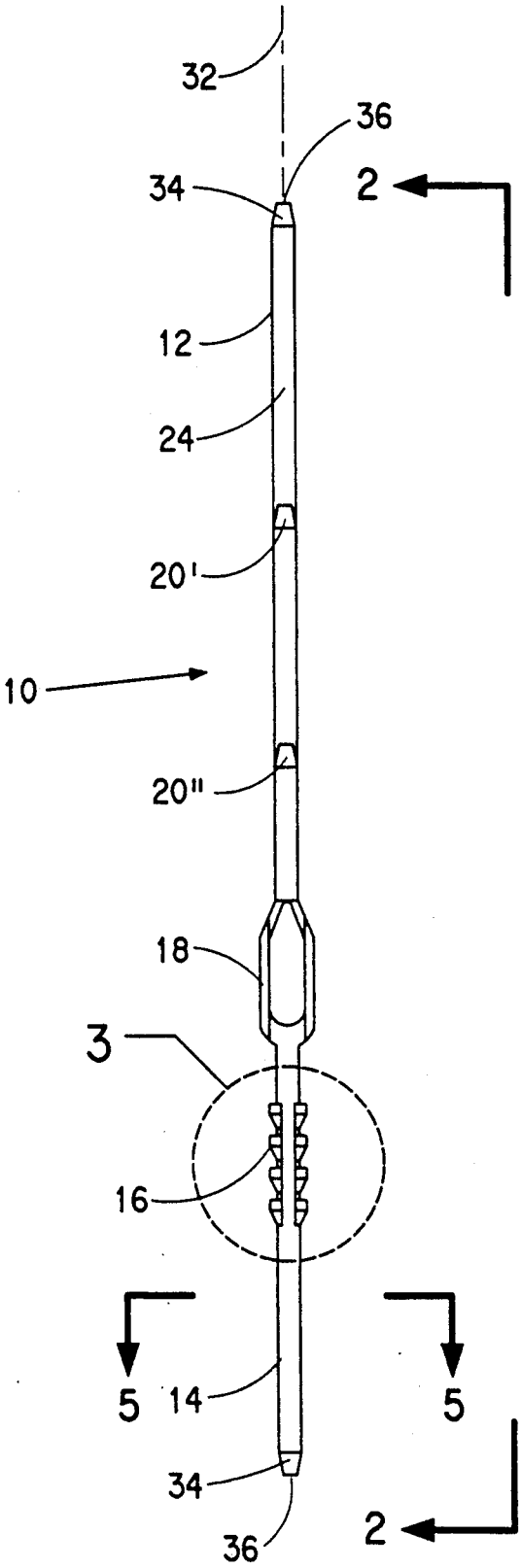
FIG. 1 is a front side view of an electrical contact element for mechanical connection in a hole through a connector housing in accordance with the present invention.

Throughout the following detailed description, similar reference characters refer to similar elements in all figures of the drawings.

Figure 2:
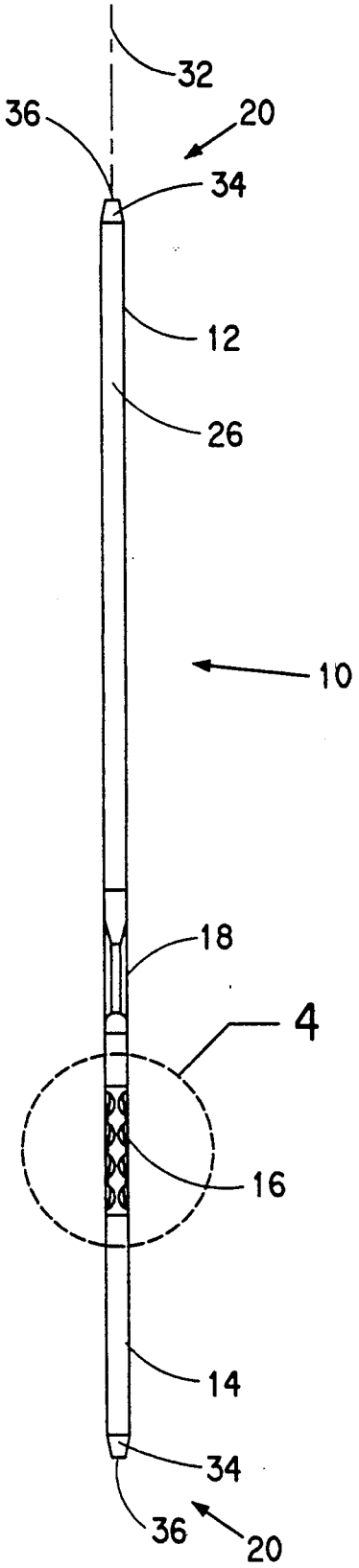
FIG. 2 is a right side view of the electrical contact element of FIG. 1 taken on the line 2—2 in the direction of the arrows.

Referring to FIG. 1, there is illustrated a front side view of an electrical contact element 10 for mechanical connection in a hole through a connector housing in accordance with the present invention. FIG. 2 is a right side view of the electrical contact element 10 of FIG. 1 taken on the line 2—2 in the direction of the arrows.

The electrical contact element 10 comprises a force receiving end portion 12, an insertion end portion 14 and a retention portion 16 between the force receiving end portion 12 and the insertion end portion 14. The electrical contact element 10 may optionally, but does not have to, have a compliant portion 18 for forcing into a plated hole through a printed circuit board. The compliant portion 18 can be a press-fit section for creating an interference fit between the contact element 10 in a hole without the need for additional fastening means, such as, soldering. Illustrative press-fit sections that can be used for the compliant section 18 include those disclosed in U.S. Pat. Nos. 4,274,699 or 4,728,164. Alternatively, the compliant portion 18 can be designed so as to require additional fastening means, such as, soldering. One such compliant section may be a star section.

Figure 5:
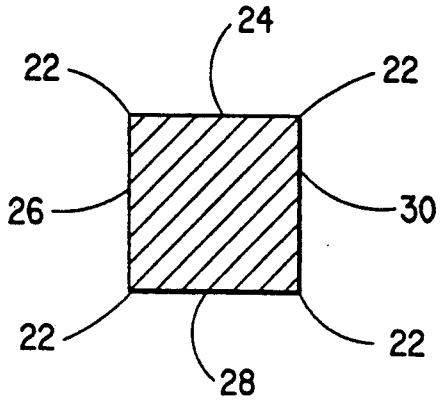
FIG. 5 is a cross sectional view of the electrical contact element of FIG. 1 taken on the line 5—5 in the direction of the arrows.

The force receiving end portion 12 and the insertion end portion 14 preferably have a square cross section, except at distal ends 20. Further, the force receiving end portion 12 and the insertion end portion 14 may have square or rounded corners 22. Square corners 22 are illustrated in FIG. 5 which discloses a cross sectional view of the electrical contact element 10 of FIG. 1 taken on the line 5—5 in the direction of the arrows.

The force receiving end portion 12 and the insertion end portion 14, thus, comprise a first substantially flat side 24, a second substantially flat side 26, a third substantially flat side 28, and a fourth substantially flat side 30. The first side 24 and the third side 28 are substantially parallel to one another. The second side 26 and the fourth side 30 are substantially parallel to one another. The first side 24 and the third side 28 are substantially perpendicular to the second side 26 and the fourth side 30.

The electrical contact element 10 has a longitudinal axis 32. The element 10 is symmetric or substantially symmetric about the longitudinal axis 32. The element 10 has a first mid-plane that contains the longitudinal axis 32 and bisects the element 10 between the first side 24 and the third side 28. The first mid-plane is, thus, parallel to the first side 24 and the third side 28. The element 10 is symmetric or substantially symmetric about the first mid-plane. The element 10 has a second mid-plane that contains the longitudinal axis 32 and bisects the element 10 between the second side 26 and the fourth side 30. The second mid-plane is, thus, parallel to the second side 26 and the fourth side 30. The element 10 is symmetric or substantially symmetric about the second mid-plane.

The distal ends 20 can be shaped like truncated pyramids having four inclined surfaces 34 which slope towards the longitudinal axis 32 of the electrical contact element 10 and intersect or terminate at a substantially flat end surface 36.

The force receiving end portion 12 and/or the insertion end portion 14 of the electrical contact element 10 can have different lengths depending on their intended uses. This is illustrated in FIG. 1 by depicting alternate positions 20' and 20'' of one of the force receiving end portion distal end 34.

Figure 3:
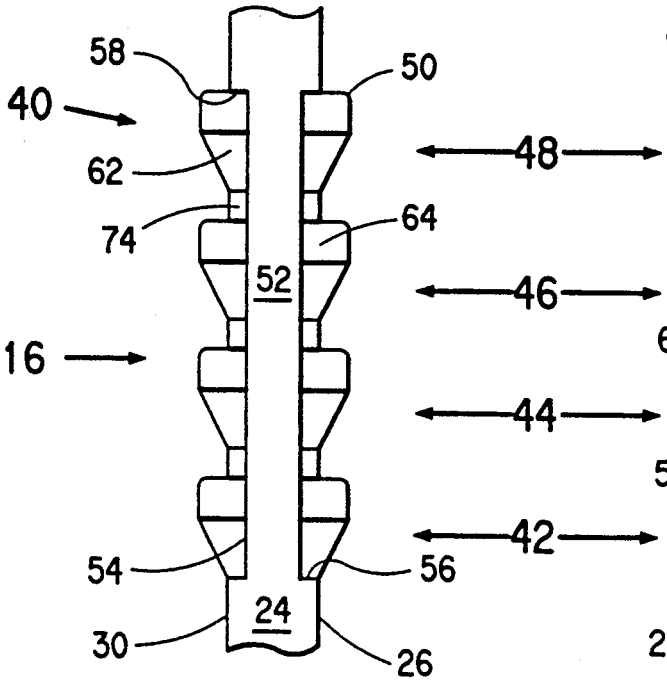
FIG. 3 is an enlarged front side view of a retention portion of the electrical contact element in circle 3 of FIG. 1.
Figure 4:
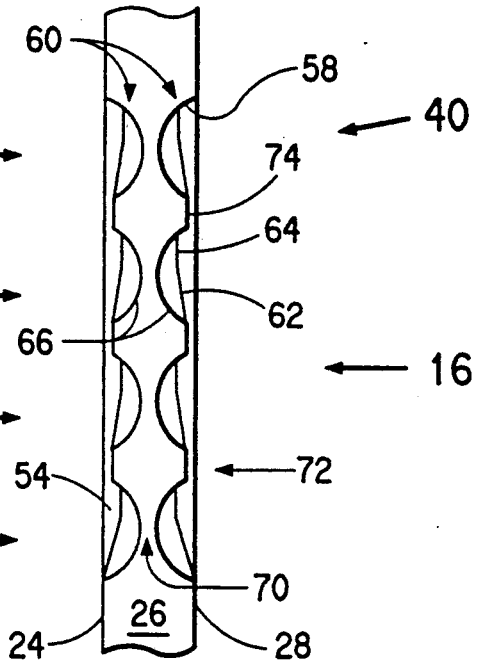
FIG. 4 is an enlarged right side view of the retention portion of the electrical contact element in circle 4 of FIG. 2.

FIG. 3 is an enlarged front side view of the retention portion 16 of the electrical contact element 10 in circle 3 of FIG. 1. FIG. 4 is an enlarged right side view of the retention portion 16 of the electrical contact element 10 in circle 4 of FIG. 2.

Referring in particular to FIG. 3, the retention portion 16 comprises a plurality of opposed upsets 40 of progressively different sizes. Multiple pairs of upsets 40 provide retention and stability of the element 10 in a housing. Preferably, the retention portion 16 has at least three pairs of the opposed upsets 40. The embodiment illustrated in the drawings has a first insertion pair 42 of the opposed upsets 40, a second insertion pair 44 of the opposed upsets 40, a third insertion pair 46 of the opposed upsets 40, and a fourth insertion pair 48 of the opposed upsets 40. The first pair 42 is the closest to the insertion end portion 14. The second pair 44 is the next or second closest to the insertion end portion 14. The third pair 46 is the third closest to the insertion end portion 14. The fourth pair 48 is the fourth closest to the insertion end portion 14.

The first pair 42 has a first distance between its distal tips 50 which is shorter than the distance between distal tips 50 of all the other pairs 44, 46, and of the opposed upsets 40. The second pair 44 has a second distance between its distal tips 50 that is sightly longer than the first distance, but is shorter than the distance between distal tips 50 of the third pair 46 and fourth pair 48 of the opposed upsets 40. The third pair 46 has a third distance between its distal tips 50 that is sightly longer than the second distance, but is shorter than the distance between distal tips 50 of the fourth pair 8 of the opposed upsets 40. The fourth pair 48 has a fourth distance between its distal tips 50 that is sightly longer than the third distance. In other words, the distance between distal tips 50 of the upsets 40 in the pairs of upsets 40 incrementally increases from the insertion end portion 14 to the force receiving portion 12.

A central portion 52 of the first side 24 and the third side 28 extends between the upsets 40 in each of the pairs of upsets 40. Each one of the central portions 52 has two shoulders 54. The shoulders 54 are generally parallel to the second side 26 and the fourth side 30. Each shoulder 54 extends between one edge of the central portions 52 and one of the upsets 40.

Referring to FIGS. 3 and 4, each one of the upsets 40 preferably comprises a pair of bumps or projections 60. Each one of the bumps or projections 60 can be described as having a first surface 62, a second surface 64 and a third surface 66. Preferably, the first surfaces 62 and the second surfaces 64 are flat or substantially flat. Preferably, the third surfaces 66 are curved or dome-like.

The first surfaces 62 and the second surfaces 64 are connected perpendicular or substantially perpendicular to the shoulders 54. The first surfaces 62 are also connected to the second surfaces 64 and the third surfaces 66. The second surfaces 64 are connected to the first surfaces 62 and third surfaces 66. The third surfaces 66 connect the first surfaces 62 and the second surfaces 64 to either the second side 26 or the fourth side 30. In FIG. 4, the third surfaces 66 are extending up from the second side 26 in a curved or dome-like fashion to meet with the upper edges of the first surfaces 62 and the second surfaces 64. Edges of the surfaces or intersections between the surfaces and the other surfaces, sides or shoulders can be rounded or angular.

An intermediate longitudinal strip 70 of the second side 26 and the fourth side 30 can optionally extend between the pairs of projections 60. A lateral strip 72 of the second side 26 and the fourth side 30 can optionally extend between each pair of the projections 60. In the embodiment illustrated in FIGS. 3 and 4, the lateral strips 72 have faces 74 extending to the shoulders 54.

Each one of the first surfaces 62 of the four projections 60 in the first pair 42 of upsets 40 has a first edge that intersects with an edge portion 56 of the first side 24 and the third side 28. As seen in FIG. 3, the first side 24 has two edge portions 56. Similarly, the third side 28 has two edge portions 56. Each one of the four first surfaces 62 of the upsets 40 in the first pair 42 incline or slope away from a respective one of the edge portions 56 towards, and at a first angle with respect to, the first mid-plane. Each one of the four first surfaces 62 of the upsets 40 in the first pair 42 have a second edge that intersects a first edge of the second surfaces 64.

Each one of the second surfaces 64 of the upsets 40 in the first pair 42 incline or slope away from the first surfaces 62 and the first mid-plane at a second angle with respect to the first mid-plane. Preferably, the second angle is less than the first angle. The second surfaces 64 may even be parallel to the first mid-plane. Each one of the second surfaces 64 of the upsets 40 in the first pair 42 intersects in a curved or rounded fashion one of the faces 74 of the lateral strips 72 between the first pair of projections 60 and the second pair of projections 60.

Each one of the four third surfaces 66 of the upsets 40 in the first pair 42 connect to distal edges of the first surfaces 62 and the second surfaces 64. Each one of the third surfaces 64 extends in a curved or globe-like fashion and intersects either the second side 26 or the fourth side 30 in a curved line.

The other projections 60 in the second, third and fourth pair of upsets 40 are configured like the aforedescribed projections 60 in the first pair 42 of upsets 40. However, the first edge of the first surfaces 62 in the projections 60 in the second, third and fourth pair of upsets 40 intersect one of the faces 74, rather than the edge portion 56. Further, the second surfaces 64 of the projections 60 in the fourth pair 48 of upsets 40 connect to a ledge 58, rather than the face 74. There are four ledges 58. Each one of the ledges 58 is defined by one of the the second surfaces 64 of the projections 60 in the fourth pair 48 of upsets 40, one of the four shoulders 54, either the first side 24 or the third side 28, and either the second side 26 or the fourth side 30.

The opposed upsets 40 are made by squeezing or pinching the edge portions 56 of the first side 24 and the third side 28 towards one another.

The contact elements 10 of the present invention can be made from any suitable metal used for electrical terminals, such as brass, phosphor bronze, beryllium copper and the like. The contact elements 10 may be plated or coated with one or more conductive layer, such as tin, nickel, pladium, gold, silver or a suitable alloy.

Figure 6:
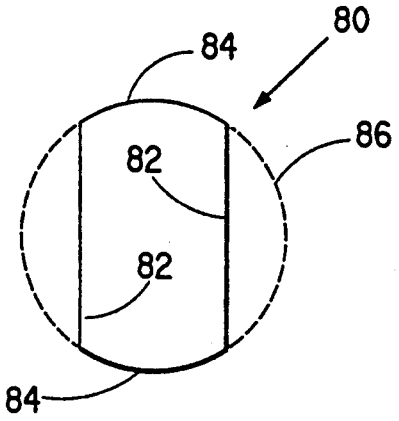
FIG. 6 is a schematic representation of a preferred embodiment of an oblong hole through a connector housing for receiving the electrical contact element of FIG. 1.

The retention portion 16 is for staking in and mechanical connection to a hole 80 through a connector housing. FIG. 6 is a schematic representation of a preferred embodiment of a substantially oblong hole 80 through a connector housing for receiving the electrical contact element of FIG. 1. The substantially oblong hole 80 has two opposed flat and parallel walls 82. The flat walls 82 are connected by cylindrical or curved walls 84 which can be parts of a same cylinder 86. Preferably, only the retention portion 16 contacts the hole wall(s) 82, 84 in the housing. This is accomplished by inserting the element 10 into the substantially oblong hole 80 such that only the upsets 40 contact the flat walls 82 in the hole geometry depicted in FIG. 6 . This provides clearance between the element 10 and the housing which avoids scraping corners 22 of the element 10 on the housing and eliminates or significantly reduces sliver formation. This hole geometry is also better for injection molding of the housing than round or square holes.

FIG. 7 a top side view of a connector housing and, specifically, a header housing for receiving a plurality of the electrical contact elements 10 of the present invention staked in oblong holes 80 through the header housing 90. FIG. 8 a right side view of a connector and, more specifically, a header 100 comprising a plurality of the electrical contact elements 10 of FIG. 1 in the header housing 90 of FIG. 7 taken on the line 8—8 in the direction of the arrows. In FIG. 8, a portion of the housing 90 has been broken away to clearly show columns of the insertion end portions 14 of the electrical contact elements 10. FIG. 9 a cross sectional view of the header housing 90 of FIG. 7 taken on the line 9—9 in the direction of the arrows combined with the electrical contact elements 10 of FIG. 1. FIG. 9 illustrates four rows of the the electrical contact elements 10 in the housing 90.

Preferably, the housing 90 is made of or from a high temperature resin, such as, polyphenylene sulfide resin.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A retention portion of an electrical contact element for mechanical connection in a hole through a connector housing comprising:

a plurality of pairs of laterally opposed upsets of progressively different sizes along a longitudinal axis of the retention portion, each of the upsets comprising a pair of separate projections, whereby when the element is inserted into the hole such that only the upsets come in contact with a wall of the hole when inserted therein, the upsets provide an incremental interference with the hole during insertion while substantially preventing sliver formation.

2. The retention portion of claim 1, wherein the hole is substantially oblong.

3. The element of claim 2, wherein the hole has two opposed flat sides.

4. The retention portion of claim 1, wherein:

there are at least three pairs of the opposed upsets; and a distance between distal tips of the upsets in each of the pairs of the opposed upsets incrementally increases from one end of the retention portion to another end of the retention portion.

5. The retention portion of claim 1, wherein each one of the projections having a first surface, a second surface and a third surface.

6. A retention portion of an electrical contact element for mechanical connection in a hole through a connector housing comprising:

a plurality of opposed upsets of progressively different sizes, wherein each one of the upsets comprises a pair of projections, each one of the projections having a first surface, a second surface and a third surface;

a first side having a central-portion and edge portions, a second side having an intermediate strip, a third side having a central-portion and edge portions and a fourth side having an intermediate strip;

shoulders extending from the central portions of the first and third sides;

the first and second surfaces connected perpendicular or substantially perpendicular to the shoulders; and the third surfaces being dome shaped and extending between the first surfaces, the second surfaces and either the intermediate strip of the second side or the intermediate strip of the fourth side, whereby when the element is inserted into the hole such that only the upsets come in contact with a wall of the hole when inserted therein, the upsets provide an incremental interference with the hole during insertion while substantially preventing sliver formation.

7. The retention portion of claim 6, wherein:

the first surfaces of a first insertion pair of the opposed upsets have first edges that intersect with the edge portions of the first and third sides; and the second surfaces of a last insertion pair of the opposed upsets connect to ledges, the ledges defined by one of the the second surfaces of the projections in the last insertion pair of opposed upsets, one of the shoulders, either the first side or the third side, and either the second side or the fourth side.

8. The retention portion of claim 6, wherein the second side and the fourth side further have lateral strips which extend between each pair of the projections; and faces connect the lateral strips to the shoulders.

9. The retention portion of claim 8, wherein:

the first surfaces of any pair of the opposed upsets between the first insertion pair of the opposed upsets and the last insertion pair of the opposed upsets have first edges that intersect with the faces;

the second surfaces of all pairs of the opposed upsets, except the last insertion pair of the opposed upsets, have second edges that intersect with the faces; and the second surfaces of the last insertion pair of the opposed upsets connect to ledges, the ledges defined by one of the the second surfaces of the projections in the last insertion pair of opposed upsets, one of the shoulders, either the first side or the third side, and either the second side or the fourth side.

10. An electrical contact element for mechanical connection in a hole through a connector housing comprising:

a force receiving end portion;

an insertion end portion; and a retention section between the force receiving end portion and the insertion end portion, the retention section including a plurality of pairs of laterally opposed upsets of progressively different sizes along a longitudinal axis of the retention portion, each of the upsets comprising a pair of separate projections, whereby then the insertion end portion is inserted into the hole such that only the upsets come in contact with a wall of the hole when inserted therein, the upsets provide an incremental interference with the hole during insertion while substantially preventing sliver formation.

11. The electrical contact element of claim 10, wherein the element comprises a pin having a substantially square cross section and the upsets extend only beyond two opposed sides of the pin.

12. The electrical contact element of claim 10, wherein the hole has two opposed flat sides.

13. The electrical contact element of claim 12, wherein the hole has two opposed flat sides.

14. The electrical contact element of claim 10, wherein:

there are at least three pairs of the opposed upsets; and a distance between distal tips of the upsets in each of the pairs of the opposed upsets incrementally increases from one end of the retention portion to another end of the retention portion.

15. The electrical contact element of claim 10, wherein each one of the projections having a first surface, a second surface and a third surface.

16. An electrical contact element for mechanical connection in a hole through a connector housing comprising:

a force receiving end portion;

an insertion end portion; and a retention section between the force receiving end portion and the insertion end portion, the retention section including;

a plurality of opposed upsets of progressively different sizes, wherein each one of the upsets comprises a pair of projections, each one of the projections having a first surface, a second surface and a third surface;

a first side having a central-portion and edge portions, a second side having an intermediate strip, a third side having a central-portion and edge portions and a fourth side having an intermediate strip;

shoulders extending from the central-portions of the first and third sides;

the first and second surfaces connected perpendicular or substantially perpendicular to the shoulders; and the third surfaces being dome shaped and extending between the first surfaces, the second surfaces and either the intermediate strip of the second side or the intermediate strip of the fourth side, whereby when the insertion end portion is inserted into the hole such that only the upsets come in contact with a wall of the hole when inserted therein, the upsets provide an incremental interference with the hole during insertion while substantially preventing sliver formation.

17. The electrical contact element of claim 16, wherein:

the first surfaces of a first insertion pair of the opposed upsets have first edges that intersect with the edge portions of the first and third sides; and the second surfaces of a last insertion pair of the opposed upsets connect to ledges, the ledges defined by one of the the second surfaces of the projections in the last insertion pair of opposed upsets, one of the shoulders, either the first side or the third side, and either the second side or the fourth side.

18. The electrical contact element of claim 16, wherein:

the second side and the fourth side further have lateral strips which extend between each pair of the projections; and faces connect the lateral strips to the shoulders.

19. The electrical contact element of claim 18, wherein:

the first surfaces of any pair of the opposed upsets between the first insertion pair of the opposed upsets and the last insertion pair of the opposed upsets have first edges that intersect with the faces;

the second surfaces of all pairs of the opposed upsets, except the last insertion pair of the opposed upsets, have second edges that intersect with the faces; and the second surfaces of the last insertion pair of the opposed upsets connect to ledges, the ledges defined by one of the the second surfaces of the projections in the last insertion pair of opposed upsets, one of the shoulders, either the first side or the third side, and either the second side or the fourth side.

20. An electrical connector comprising:

a housing having a plurality of hole arranged in rows and columns;

an electrical contact element for mechanical connection in each one of the holes, each one of the electrical contact elements comprising:

a force receiving end portion;

an insertion end portion; and a retention section between the force receiving end portion and the insertion end portion, the retention section including a plurality of pairs of laterally opposed upsets of progressively different sizes along a longitudinal axis of the retention portion, each of the upsets comprising a pair of separate projections.

whereby when the insertion end portion is inserted into the hole such that only the upsets come in contact with a wall of the hole when inserted therein, the upsets provide an incremental interference with the hole during insertion while substantially preventing sliver formation.

21. The electrical connector of claim 20, wherein the connector is a header.

22. The electrical connector of claim 20, wherein the housing is made from polyphenylene sulfide resin.

* * * * *